US008078076B2

(12) United States Patent
Komai

(10) Patent No.: US 8,078,076 B2
(45) Date of Patent: Dec. 13, 2011

(54) IMAGE FORMING APPARATUS THAT CONTROLS WIDTH OF CORRECTION PATTERN

(75) Inventor: Kunihiro Komai, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 943 days.

(21) Appl. No.: 12/076,128

(22) Filed: Mar. 14, 2008

(65) Prior Publication Data

US 2008/0232825 A1 Sep. 25, 2008

(30) Foreign Application Priority Data

Mar. 19, 2007 (JP) ..... 2007-071136
May 30, 2007 (JP) ..... 2007-143992

(51) Int. Cl.
*G03G 15/00* (2006.01)

(52) U.S. Cl. ..... 399/72; 399/301; 347/116; 430/47.2

(58) Field of Classification Search ..... 399/9, 15, 399/72, 301; 347/116; 430/47.2
See application file for complete search history.

(56) References Cited

U.S. PATENT DOCUMENTS 5,627,649 A * 5/1997 Sawayama et al. ..... 358/296
5,867,759 A * 2/1999 Isobe et al. ..... 399/301
5,991,558 A * 11/1999 Emi et al. ..... 399/49
6,285,849 B1 * 9/2001 Shimada et al. ..... 399/301
6,434,347 B2 * 8/2002 Nakayasu ..... 399/49
6,633,734 B2 * 10/2003 Maebashi et al. ..... 399/49
6,985,678 B2 * 1/2006 Maebashi et al. ..... 399/39
7,158,264 B2 * 1/2007 Inoue ..... 358/3.14
7,260,336 B2 * 8/2007 Shimura et al. ..... 399/49
7,914,096 B2 * 3/2011 Hagiwara et al. ..... 347/14
2004/0258437 A1 * 12/2004 Kakutani et al. ..... 399/301
2005/0047834 A1 * 3/2005 Tomita et al. ..... 399/301
2005/0083530 A1 * 4/2005 Ogihara et al. ..... 356/446
2005/0134874 A1 * 6/2005 Overall et al. ..... 358/1.9
2006/0024077 A1 * 2/2006 Scheuer et al. ..... 399/74
2006/0087528 A1 * 4/2006 Rodenas et al. ..... 347/19
2008/0225098 A1 * 9/2008 Hagiwara et al. ..... 347/101

FOREIGN PATENT DOCUMENTS

JP 2005-202432 7/2005

* cited by examiner

*Primary Examiner* — David Gray
*Assistant Examiner* — Geoffrey Evans
(74) *Attorney, Agent, or Firm* — IPUSA, LLC

(57) ABSTRACT

An image forming apparatus generates a color image on a transfer belt by superimposing toner images of respective colors generated by image forming units, and transfers the color image onto a transfer medium. The image forming apparatus includes a correction pattern forming unit configured to form a correction pattern for correcting color misalignment on the transfer belt, a detection sensor configured to detect the correction pattern formed on the transfer belt by the correction pattern forming unit, and a correction control unit configured to control a width of the correction pattern in response to an output of the detection sensor produced by detecting the correction pattern.

11 Claims, 8 Drawing Sheets

IMAGE FORMING APPARATUS THAT CONTROLS WIDTH OF CORRECTION PATTERN

BACKGROUND OF THE INVENTION

1. Field of the Invention

The disclosures herein relate to the control of width of correction patterns used for the correction of color alignment in image forming apparatuses.

2. Description of the Related Art

In recent years, color image forming apparatuses have been widely used as apparatus for printing images. Color image forming apparatuses form a transfer color image on a transfer belt by superimposing toner images in respective colors created by electrostatic imaging processes. This transfer color image is then transferred onto a transfer sheet. In such color image forming apparatuses, a tandem-type configuration is widely used.

In color image forming apparatuses having the above-noted configuration, toner images in respective colors may not be aligned at the correct position due to error in spacing between the axes of respective photoconductive drums, error in parallelism between the respective photoconductive drums, error in the position of a deflecting mirror for deflecting a laser beam in a light emission unit, error in the write timing of an electrostatic image on the photoconductive drums, and so on. This gives rise to the problem of color misalignment. There is thus a need to correct the misalignment of color toner images.

Japanese Patent Application Publication No. 2005-202432 discloses different operation modes, which include a mode in which multiple different processes are performed, a mode in which a print time is shortened, and a mode in which print quality is improved. A user is given a choice as to which mode is to be used. Positional alignment is then performed in conformity with the mode of choice.

It is necessary to improve the accuracy of correction of color misalignment occurring due to various factors in order to obtain a high-quality color image in a tandem-type color image forming apparatus.

Accordingly, there is a need for an image forming apparatus in which the accuracy of correction of color misalignment is improved. There is also a need for a method of controlling the width of correction patterns.

SUMMARY OF THE INVENTION

It is a general object of at least one embodiment of the present invention to provide an image forming apparatus that substantially eliminates one or more problems caused by the limitations and disadvantages of the related art.

In one embodiment, an image forming apparatus generates a color image on a transfer belt by superimposing toner images of respective colors generated by image forming units, and transfers the color image onto a transfer medium. The image forming apparatus includes a correction pattern forming unit configured to form a correction pattern for correcting color misalignment on the transfer belt, a detection sensor configured to detect the correction pattern formed on the transfer belt by the correction pattern forming unit, and a correction control unit configured to control a width of the correction pattern in response to an output of the detection sensor produced by detecting the correction pattern.

According to another embodiment, an image forming apparatus which generates a color image on a transfer belt by superimposing toner images of respective colors generated by image forming units, and transfers the color image onto a transfer medium, includes a correction pattern forming unit configured to form a correction pattern for correcting color misalignment on the transfer belt outside an area in which said color image is formed, a detection sensor configured to detect the correction pattern formed on the transfer belt by the correction pattern forming unit, and a correction control unit configured to control at least one of a length of the correction pattern in a main-scan direction and a length of the correction pattern in a sub-scan direction by controlling the correction pattern forming unit in response to an output of the detection sensor produced by detecting the correction pattern.

According to at least one embodiment of the present invention, the accuracy of color alignment in an image forming apparatus can be improved by controlling a correction pattern for the correction of color misalignment.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

A description will first be given of a first embodiment.

Figure 1:
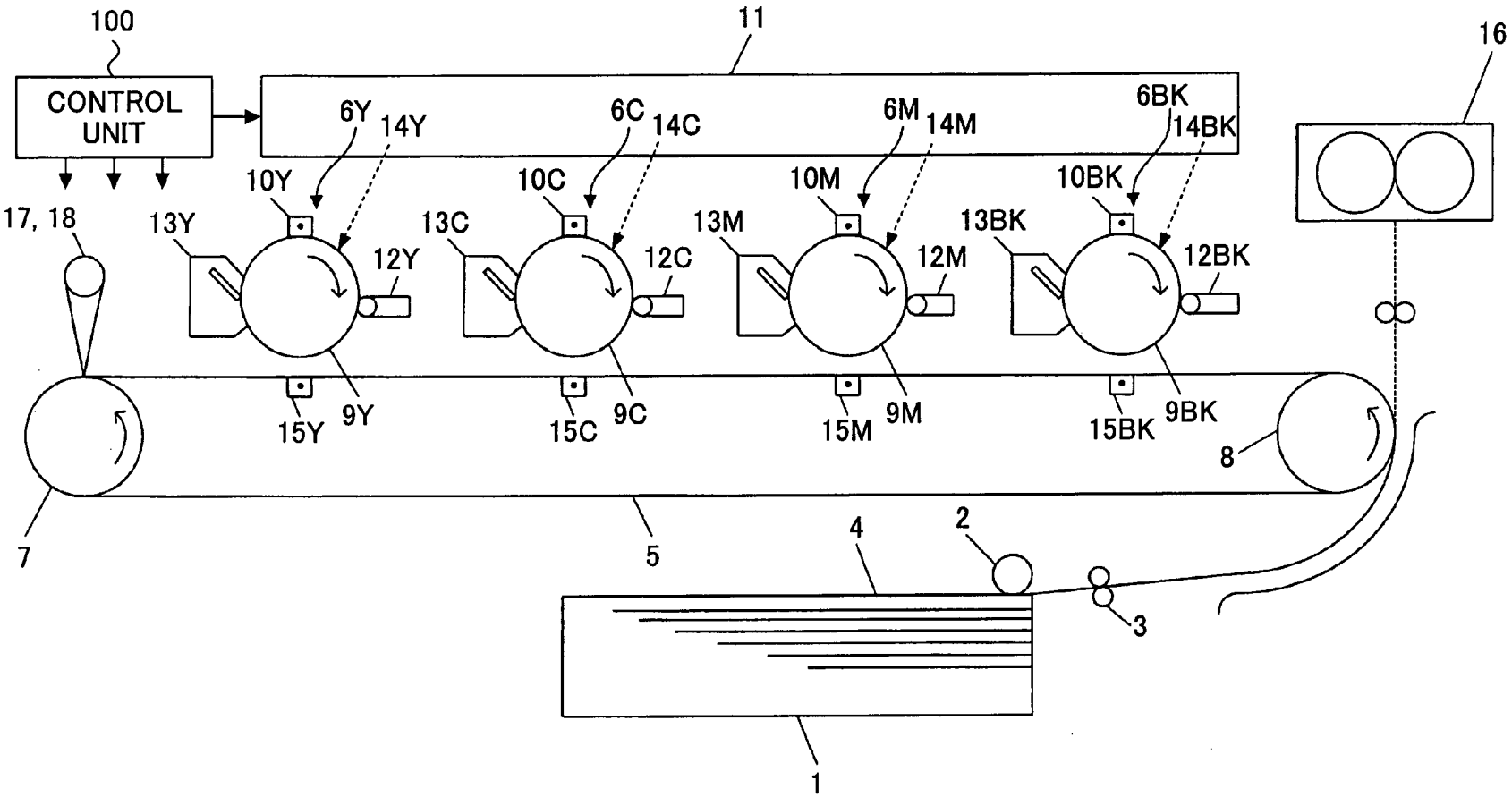
FIG. 1 is a block diagram showing the configuration of a color image forming apparatus according to an embodiment of the present invention.

FIG. 1 is a block diagram showing the configuration of a color image forming apparatus according to an embodiment of the present invention. As shown in FIG. 1, the color image forming apparatus has image forming units for respective colors arranged in line along a transfer belt 5. This configuration is referred to as a tandem-type configuration.

Along the transfer belt 5, image forming units 6BK, 6M, 6C, and 6Y are arranged in the order listed, starting from the upstream side with respect to the travel direction of the transfer belt 5. The image forming units 6BK, 6M, 6C, and 6Y have an identical structure. The only difference is the colors of toner images formed by these units.

The image forming unit 6BK forms a black image. The image forming unit 6M forms a magenta image. The image forming unit 6C forms a cyan image. The image forming unit 6Y forms a yellow image. In the following, the image forming unit 6BK will specifically be described. A description of the other image forming units 6M, 6C, and 6Y will be omitted as the image forming units 6M, 6C, and 6Y are basically the same as the image forming unit 6BK. In the drawings, these image forming units 6M, 6C, and 6Y will be denoted by respective symbols "M," "C," and "Y".

The transfer belt 5 is wrapped around a drive roller 7 and a driven roller 8 wherein the drive roller 7 is driven to rotate. A drive motor (not shown) rotates the drive roller 7. The drive motor, the drive roller 7, and the driven roller 8 together serve as a drive unit for moving the transfer belt 5, The image forming unit 6BK includes a photoconductive drum 9BK. In the space around this photoconductive drum 9BK, the image forming unit 6BK further includes a charger unit 10BK, an exposure unit 11, a development unit 12BK, a photoconductive-drum cleaner (not shown), and a discharger unit 13BK. The exposure unit 11 is configured to emit laser beams 14BK, 14M, 14C, and 14Y, which are exposure light beams corresponding to the respective colors of images formed by the image forming units 6BK, 6M, 6C, and 6Y.

At the time of forming an image, the charger unit 10BK electrically charges the circumferential surface of the photoconductive drum 9BK uniformly in the dark. The laser beam 14BK emitted by the exposure unit 11 corresponding to a black image is shone on the circumferential surface, thereby creating an electrostatic latent image. The development unit 12BK converts this electrostatic latent image into a visible image by use of black toner. As a result, a black toner image is formed on the photoconductive drum 9BK. The toner image is then transferred onto the transfer belt 5 at the position at which the photoconductive drum 9BK touches the transfer belt 5.

Residual toner staying on the circumferential surface of the photoconductive drum 9BK is removed by the photoconductive-drum cleaner after the transfer of the toner image. The discharger unit 13BK then discharges the photoconductive drum 9BK to make the photoconductive drum 9BK ready for the next image forming process.

The transfer belt 5 moves towards the image forming unit 6M, so that a next image is transferred thereon. The image forming unit 6M creates a magenta toner image on the photoconductive drum 9M by performing a process substantially the same as the image forming process performed by the image forming unit 6BK. The created toner image is then transferred onto the transfer belt 5 to be superimposed on the black image that is already formed on the transfer belt 5.

The transfer belt 5 further moves towards the image forming units 6C and 6Y. Through operations substantially the same as described above, a cyan toner image formed on the photoconductive drum 9C and a yellow toner image formed on the photoconductive drum 9Y are transferred onto the transfer belt 5 in a superimposing manner. Consequently, a full color image is formed on the transfer belt 5.

A sheet 4 is fed from a sheet feeder tray 1 by the operation of a sheet feeder roller 2 and separating rollers 3. The full color toner image on the transfer belt 5 is transferred to the sheet 4 at the position at which the transfer belt 5 comes in contact with the sheet 4. The full color toner image is thus formed on the sheet 4. The sheet 4 having the full color superimposed image formed thereon is ejected to outside the image forming apparatus after the fusing of the image by a fuser 16.

A control unit 100 controls the image forming process of the color image forming apparatus as described above. For example, the control unit 100 supplies image data signals to the exposure unit 11 to cause the exposure unit 11 to generate laser beams modulated in response to these image data signals. Further, the control unit 100 supplies timing signals to various parts of the image forming apparatus to control the operation timing of these parts. For example, the control unit 100 adjusts the timing of write synchronizing signals supplied to the exposure unit 11 to control the position of images.

In the color image forming apparatus having the above-described configuration, toner images in respective colors may not be aligned at the correct position due to error in spacing between the axes of respective photoconductive drums 9BK, 9M, 9C, and 9Y, error in parallelism between the respective photoconductive drums 9BK, 9M, 9C, and 9Y, error in the position of a deflecting mirror (not shown) for deflecting a laser beam in the exposure unit 11, error in the write timing of an electrostatic image on the photoconductive drums 9BK, 9M, 9C, and 9Y, and so on. This gives rise to the problem of color misalignment.

There is thus a need to correct the misalignment of color toner images. As shown in FIG. 1, image detection sensors 17 and 18 opposing the transfer belt 5 are provided on the downstream side relative to the image forming unit 6Y. The image detection sensors 17 and 18 are secured on a single board, such that the image detection sensors 17 and 18 are arranged in a main scan direction that is perpendicular to the travel direction of the transfer belt 5.

Figure 2:
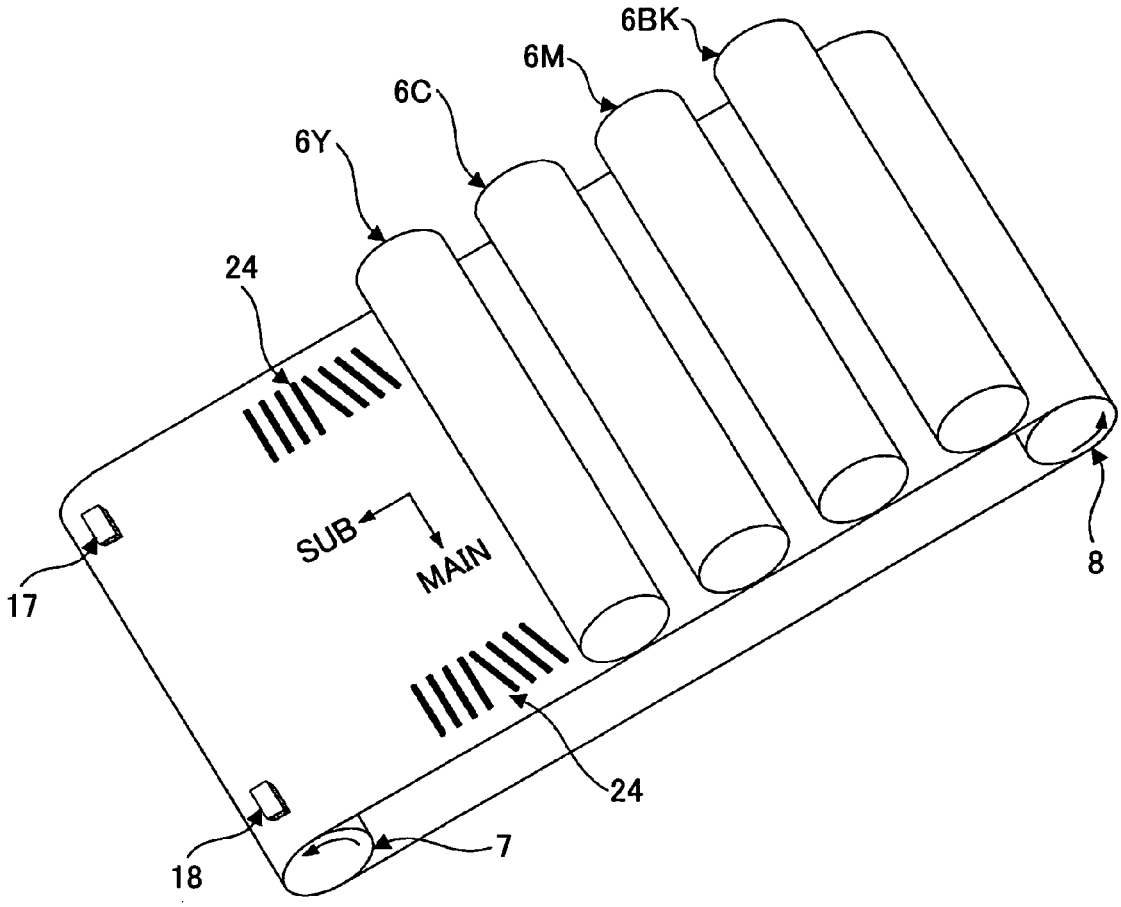
FIG. 2 is a drawing showing image detection sensors together with surrounding components.
Figure 3:
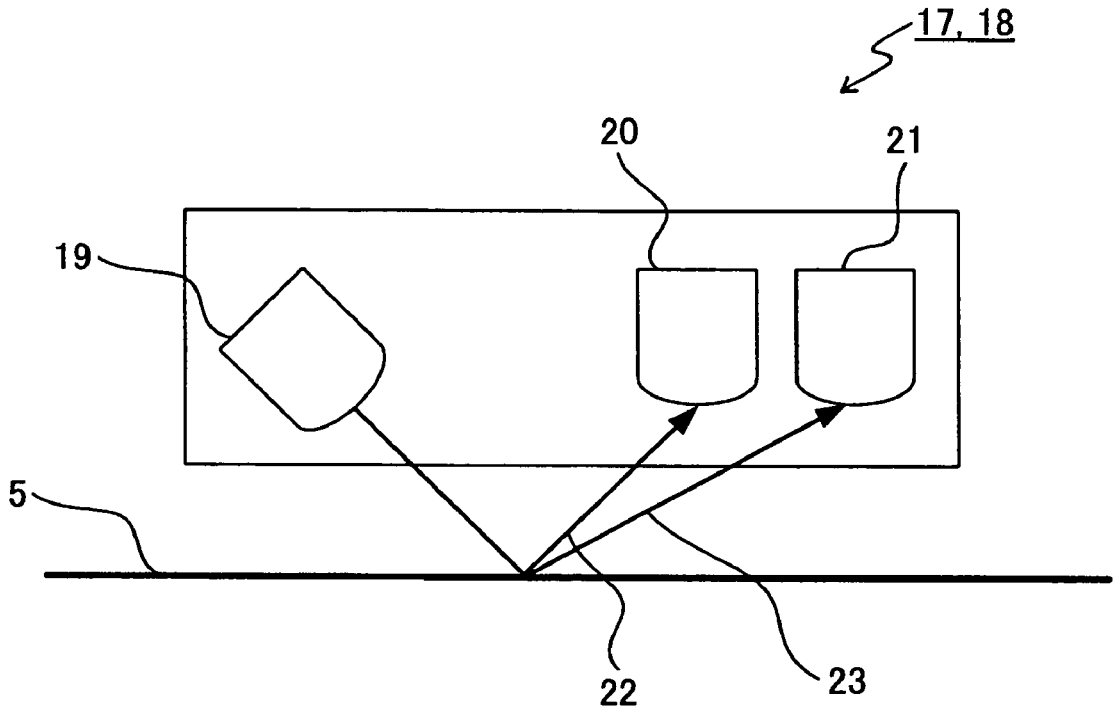
FIG. 3 is an expanded view of an image detection sensor.

FIG. 2 is a drawing showing the image detection sensors 17 and 18 together with surrounding components. FIG. 3 is an expanded view of the image detection sensors 17 and 18. Each of the image detection sensors 17 and 18 includes a light emitting unit 19, a regular-reflection receiving device 20, and a diffuse-reflection receiving device 21 to detect a misalignment correction pattern 24 formed on the transfer belt 5. The image detection sensors 17 and 18 are arranged at the opposite ends in the main scan direction, respectively. The misalignment correction pattern 24 is formed for each of the image detection sensors 17 and 18. A signal detected by the regular-reflection receiving device 20 is used to correct positional misalignment.

Specifically, the image forming apparatus performs correction for color positional misalignment prior to the forming of actual color images on the sheet 4. To this end, the image forming units 6BK, 6M, 6C, and 6Y form the misalignment correction pattern 24 printed in respective colors on the transfer belt 5. The transfer belt 5 is driven to move the misalignment correction pattern 24 for detection by the image detection sensors 17 and 18. The color misalignment correction process uses at least one of a detection signal output from the regular-reflection receiving device 20 upon detecting the misalignment correction pattern 24 and a detection signal output from the diffuse-reflection receiving device 21 upon detecting the misalignment correction pattern 24. Specifically, a process such as the adjustment of timing of a write synchronizing signal in the exposure unit 11 is performed based on these detection signals. Various schemes are known for the configuration of the misalignment correction pattern 24 and the detail of the color misalignment correction. The present invention is not limited to a particular scheme.

Figure 4:
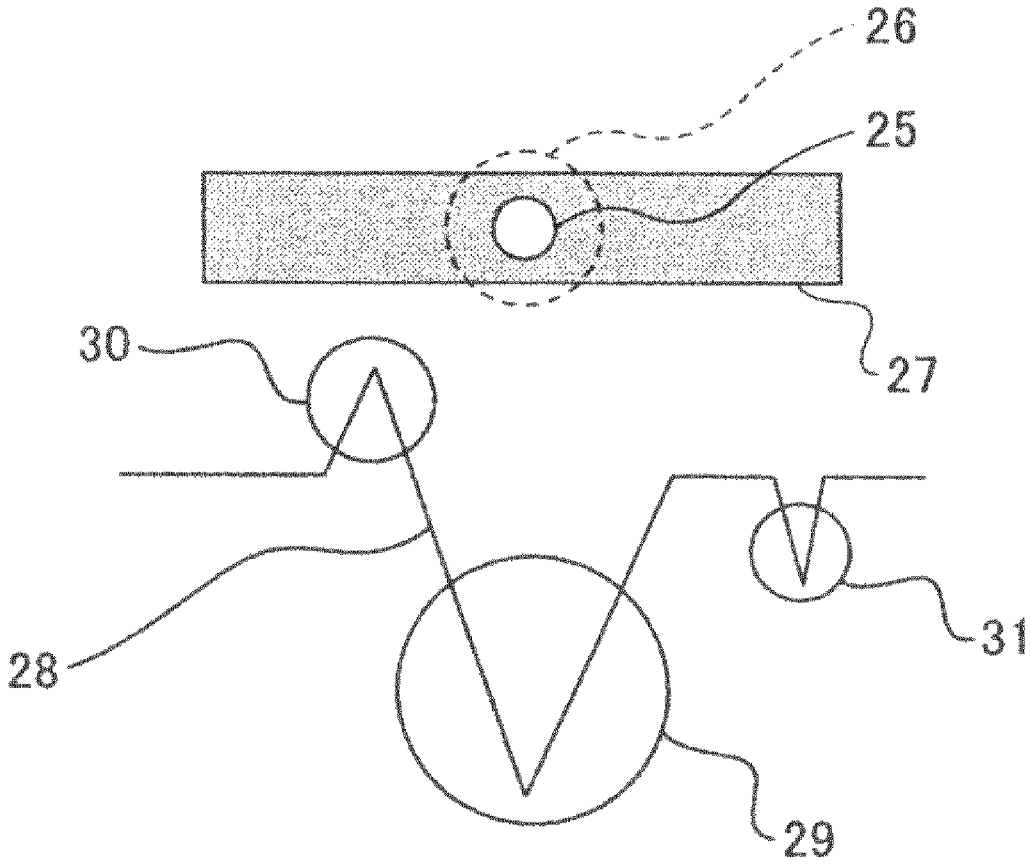
FIG. 4 is a drawing showing a signal detected by a regular-reflection receiving device.

FIG. 4 is a drawing showing a signal detected by the regular-reflection receiving device 20. With respect to the beam shone on the correction pattern by the light emitting unit 19, a regular-reflection detection signal 28 includes a regular-reflection peak 29 corresponding to regular reflection light 25, a diffuse-reflection peak 30 corresponding to diffuse reflection light 26, and a noise peak 31.

For the purpose of correcting positional misalignment, the accuracy of correction of color misalignment increases as the regular-reflection peak 29 becomes increasingly sharp to go below a certain threshold value and also as the diffuse-reflection peak 30 decreases. Further, when a light beam spot illuminates a correction pattern 27 that is one of the elements constituting the misalignment correction pattern 24, the diffuse-reflection peak 30 becomes larger in response to an increase in the overlap between the correction pattern 27 and a diffuse-reflection-related beam-exposed area 26 corresponding to the diffuse reflection light detected by the regular-reflection receiving device 20.

In FIG. 4, a regular-reflection-related beam-exposed area 25 indicates a beam-exposed area on the surface of the transfer belt 5 for which the regular-reflection receiving device 20 detects regular reflection light. Namely, the regular reflection component of the light beam emitted by the light emitting unit 19 as reflected by the regular-reflection-related beam-exposed area 25 is detected by the regular-reflection receiving device 20. Further, the diffuse-reflection-related beam-exposed area 26 indicates a beam-exposed area on the surface of the transfer belt 5 for which the regular-reflection receiving device 20 detects diffuse reflection light. Namely, the diffuse reflection component of the light beam emitted by the light emitting unit 19 as reflected by the diffuse-reflection-related beam-exposed area 26 is detected by the regular-reflection receiving device 20.

As previously described, there is a need to reduce the overlap between the correction pattern 27 and the diffuse-reflection-related beam-exposed area 26. In order to do so, it is desirable to make the width of the correction pattern 27 equal to the size (diameter) of the regular-reflection-related beam-exposed area 25. The regular-reflection detection signal 28 is checked in advance by using an ideal correction pattern. Based on this check, a threshold value for the regular-reflection peak 29 and a threshold value for the diffuse-reflection peak 30 are obtained. These threshold values are then used for the control of a correction pattern.

Figure 5:
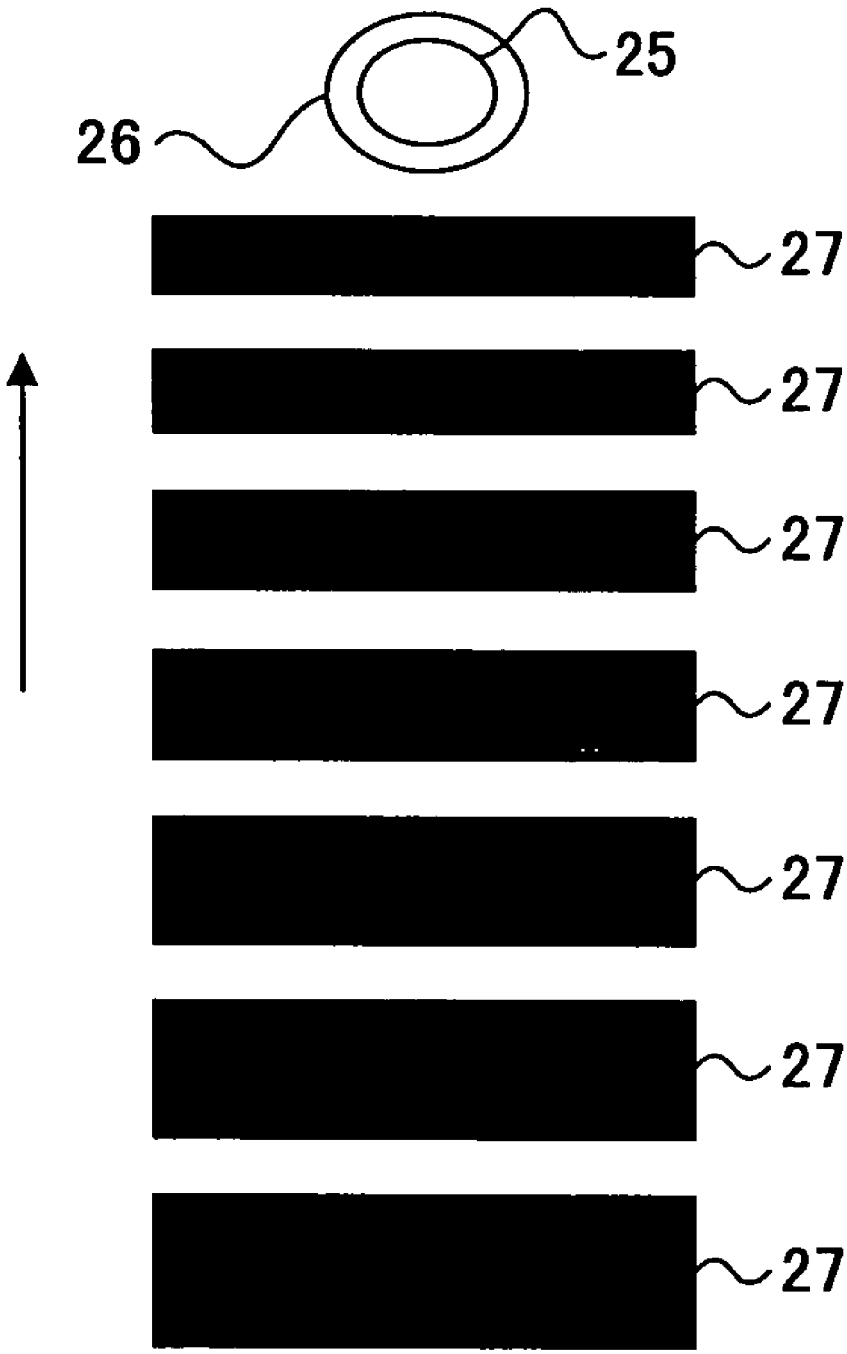
FIG. 5 is a drawing showing a set of correction patterns used for the purpose of making the width of a correction pattern equal to the size of the regular-reflection-related beam-exposed area.

FIG. 5 is a drawing showing a set of correction patterns used for the purpose of making the width of a correction pattern equal to the size of the regular-reflection-related beam-exposed area 25. A plurality of correction patterns 27 are generated in an ascending order of width on the transfer belt 5. The image detection sensors 17 and 18 then detect the set of correction patterns 27 one by one.

As detection is performed in an ascending order of width, a check is made as to whether the regular-reflection peak 29 and diffuse-reflection peak 30 of the regular-reflection detection signal 28 satisfy their respective threshold values. In the case of the regular-reflection peak 29, the phrase "peak satisfies its threshold value" means that the (negative valued) regular-reflection peak 29 falls below its threshold (first threshold). In the case of the diffuse-reflection peak 30, the phrase "peak satisfies its threshold value" means that the diffuse-reflection peak 30 does not reach its threshold value (second threshold).

In reality, the detection signal detected by the regular-reflection receiving device 20 includes both a regular-reflection light component and a diffuse-reflection light component mixed with each other. In such a detection signal waveform, the regular-reflection light component is regarded as a signal component, and the diffuse-reflection light component is regarded as a noise component. With respect to a waveform forming the regular-reflection peak 29, a contribution from the regular-reflection light is sufficiently larger than a contribution from the diffuse-reflection light. With respect to a waveform forming the diffuse-reflection peak 30, on the other hand, a contribution from the diffuse-reflection light is almost fully predominant. Accordingly, desired conditions are those in which the amplitude of the waveform of the regular-reflection peak 29 is sufficiently large (i.e., the downward peak is lower than a predetermined threshold), and the amplitude of the waveform of the diffuse-reflection peak 30 is sufficiently small (i.e., the upward peak is lower than a predetermined threshold). When such desirable conditions are met, the magnitude of the regular-reflection light component regarded as a signal component is larger than a predetermined threshold, and the magnitude of the diffuse-reflection light component regarded as a noise component is smaller than a predetermined threshold.

Figure 6:
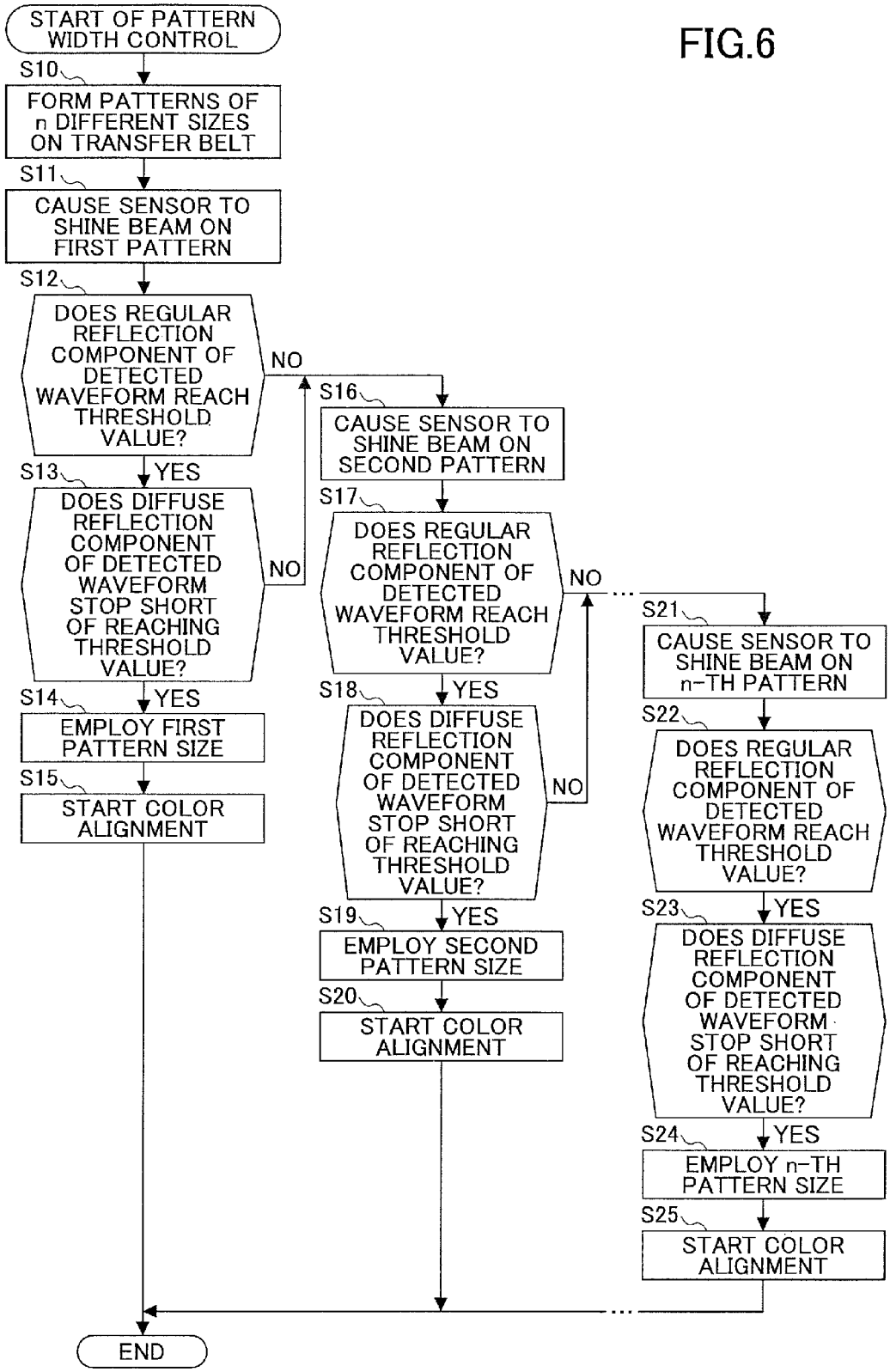
FIG. 6 is a flowchart showing a procedure according to a first embodiment.

FIG. 6 is a flowchart showing the procedure of determining a width of a correction pattern. The procedure shown in this flowchart is performed by the control unit 100 shown in FIG. 1.

Upon the start of the control of pattern width, patterns of n different sizes are formed on the transfer belt 5 (step S10). The image detection sensors 17 and 18 shine a light beam on a first patch (i.e., the first correction pattern 27) (step S11). A check is then made as to whether the regular-reflection component of the signal waveform detected by the regular-reflection receiving device 20 reaches its threshold value (step S12).

If the regular-reflection component reaches the threshold value (YES in step S12), a check is made as to whether the diffuse-reflection component of the signal waveform detected by the regular-reflection receiving device 20 stops short of reaching its threshold value (step S13). If the diffuse-reflection component stops short of reaching the threshold value (YES in step S13), the size of the first pattern is chosen for use (step S14). Color alignment (i.e., correction of color misalignment) then starts by using the first pattern having the size that has been chosen (step S15).

If it is found in step S12 that the regular-reflection component does not reach its threshold value (NO in step S12) or if it is found in step S13 that the diffuse-reflection component reaches its threshold value (NO in step S13), the image detection sensors 17 and 18 shine a light beam on the second pattern (step S16). A check is then made as to whether the regular-reflection component of the signal waveform detected by the regular-reflection receiving device 20 reaches its threshold value (step S17).

If the regular-reflection component reaches the threshold value (YES in step S17), a check is made as to whether the diffuse-reflection component of the signal waveform detected by the regular-reflection receiving device 20 stops short of reaching its threshold value (step S18). If the diffuse-reflection component stops short of reaching the threshold value (YES in step S18), the size of the second pattern is chosen for use (step S19). Color alignment (i.e., correction of color misalignment) then starts by using the second pattern having the size that has been chosen (step S20).

If it is found in step S17 that the regular-reflection component does not reach its threshold value (NO in step S17) or if it is found in step S18 that the diffuse-reflection component reaches its threshold value (NO in step S18), the image detection sensors 17 and 18 shine a light beam on the $n^{th}$ pattern (step S21). A check is then made as to whether the regular-reflection component of the signal waveform detected by the regular-reflection receiving device 20 reaches its threshold value (step S22). Further, a check is made as to whether the diffuse-reflection component of the signal waveform detected by the regular-reflection receiving device 20 stops short of reaching its threshold value (step S23). If the regular-reflection component reaches its threshold value (YES in step S22) and if the diffuse-reflection component stops short of reaching its threshold value (YES in step S23), the size of the $n^{th}$ pattern is chosen for use (step S24). Color alignment (i.e., correction of color misalignment) then starts by using the $n^{th}$ pattern having the size that has been chosen (step S25).

In the example described above, n is supposed to be 3. In the present invention, n is not limited 3, but may be any number equal to or greater than 2. For example, the procedure may come to an end upon checking the second pattern. Alternatively, the third pattern may be checked upon checking the second pattern, and, then, the fourth pattern may be checked upon checking the third pattern. Subsequent patterns will then be checked successively until the $n^{th}$ pattern is checked in the end.

In the following, a second embodiment will be described.

In the second embodiment, the image forming apparatus of the first embodiment is used, and the method of controlling a correction pattern is the same as that of the first embodiment. In the second embodiment, however, the control of a correction pattern is performed at constant intervals. Such constant intervals may be defined by the total number of printed sheets, the number of sheets printed by one job, etc.

In the following, a third embodiment will be described.

In the third embodiment, the image forming apparatus of the first embodiment is used, and the method of controlling a correction pattern is the same as that of the first embodiment. In the third embodiment, however, the control of a correction pattern is performed in response to a change in ambient temperature. Specifically, the control of a correction pattern may be performed in response to a change in ambient temperature by X° C.

In the following, a fourth embodiment will be described.

In the fourth embodiment, an additional condition is used in controlling a color misalignment correction pattern. Namely, if the regular-reflection peak 29 satisfies its threshold value, it will be further required that the width of the peak waveform taken at this threshold value is greater than a predetermined width. To this end, color misalignment correction may be performed by using various color misalignment correction patterns in experiments to measure the amount of resulting color misalignment. The waveform providing the least color misalignment is then selected, which provides a required threshold value and a required width of the waveform taken at this threshold value that will be used as references.

Figure 7:
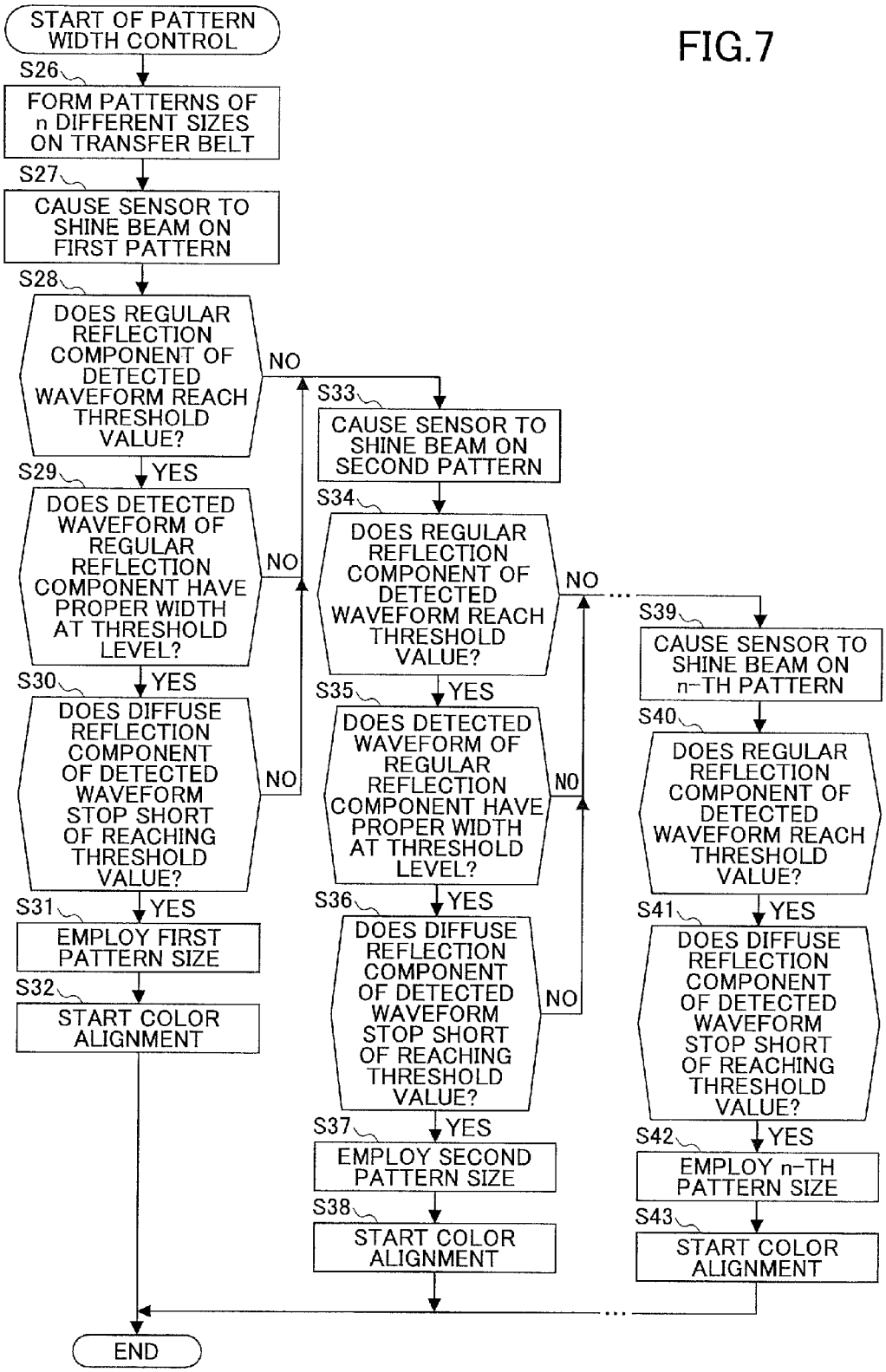
FIG. 7 is a flowchart showing a procedure according to a fourth embodiment.

FIG. 7 is a flowchart showing the procedure for determining a width of a correction pattern. The procedure shown in this flowchart is performed by the control unit 100 shown in FIG. 1.

Upon the start of the procedure for control of pattern width, patterns of n different sizes are formed on the transfer belt 5 (step S26). The image detection sensors 17 and 18 shine a light beam on the first patch (i.e., the first correction pattern 27) (step S27). A check is then made as to whether the regular-reflection component of the signal waveform detected by the regular-reflection receiving device 20 reaches its threshold value (step S28).

If the regular-reflection component reaches the threshold value (YES in step S28), a check is made as to whether the regular-reflection component of the detected signal waveform has a proper waveform width at the threshold value (step S29). If the width of the regular-reflection component exceeds a proper waveform width (YES in step S29), a check is made as to whether the diffuse-reflection component of the signal waveform detected by the regular-reflection receiving device 20 stops short of reaching its threshold value (step S30). If the diffuse-reflection component stops short of reaching the threshold value (YES in step S30), the size of the first pattern is chosen for use (step S31). Color alignment (i.e., correction of color misalignment) then starts by using the first pattern having the size that has been chosen (step S32).

If it is found in step S28 that the regular-reflection component does not reach its threshold value (NO in step S28), if it is found in step S29 that the regular-reflection component does not have a proper waveform width (NO in step S29), or if it is found in step S30 that the diffuse-reflection component reaches its threshold value (NO in step S30), the image detection sensors 17 and 18 shine a light beam on the second pattern (step S33). A check is then made as to whether the regular-reflection component of the signal waveform detected by the regular-reflection receiving device 20 reaches its threshold value (step S34).

If the regular-reflection component reaches the threshold value (YES in step S34), a check is made as to whether the regular-reflection component of the detected signal waveform has a proper waveform width at the threshold value (step S35). If the width of the regular-reflection component exceeds a proper waveform width (YES in step S35), a check is made as to whether the diffuse-reflection component of the signal waveform detected by the regular-reflection receiving device 20 stops short of reaching its threshold value (step S36). If the diffuse-reflection component stops short of reaching the threshold value (YES in step S36), the size of the second pattern is chosen for use (step S37). Color alignment (i.e., correction of color misalignment) then starts by using the second pattern having the size that has been chosen (step S38).

If it is found in step S34 that the regular-reflection component does not reach its threshold value (NO in step S34), if it is found in step S35 that the regular-reflection component does not have a proper waveform width (NO in step S35), or if it is found in step S36 that the diffuse-reflection component reaches its threshold value (NO in step S36), the image detection sensors 17 and 18 shine a light beam on the $n^{th}$ pattern (step S39). A check is then made as to whether the regular-reflection component of the signal waveform detected by the regular-reflection receiving device 20 reaches its threshold value (step S40). A check is further made as to whether the diffuse-reflection component of the signal waveform detected by the regular-reflection receiving device 20 stops short of reaching its threshold value (step S41).

If the regular-reflection component reaches its threshold value (YES in step S40) and if the diffuse-reflection component stops short of reaching its threshold value (YES in step S41), the size of the $n^{th}$ pattern is chosen for use (step S42). Color alignment then starts by using the $n^{th}$ pattern having the size that has been chosen (step S43).

In the fourth embodiment, the control of a correction pattern may be performed at constant intervals. Such constant intervals may be defined by the total number of printed sheets, the number of sheets printed by one job, etc. Further, the control of a correction pattern may be performed in response to a change in ambient temperature.

In the fourths embodiment, further, the misalignment correction pattern 24 may be formed outside a typical image forming area on the transfer belt 5. At least one of the length of the misalignment correction pattern 24 in the main-scan direction and the length of the misalignment correction pattern 24 in the sub-scan direction may be adjusted.

The accuracy of color alignment can be improved by adjusting the length of a correction pattern to an optimum length in response to the detection results obtained by the image detection sensors 17 and 18.

The first through fourth embodiments described above may be modified as described in the following.

Figure 8:
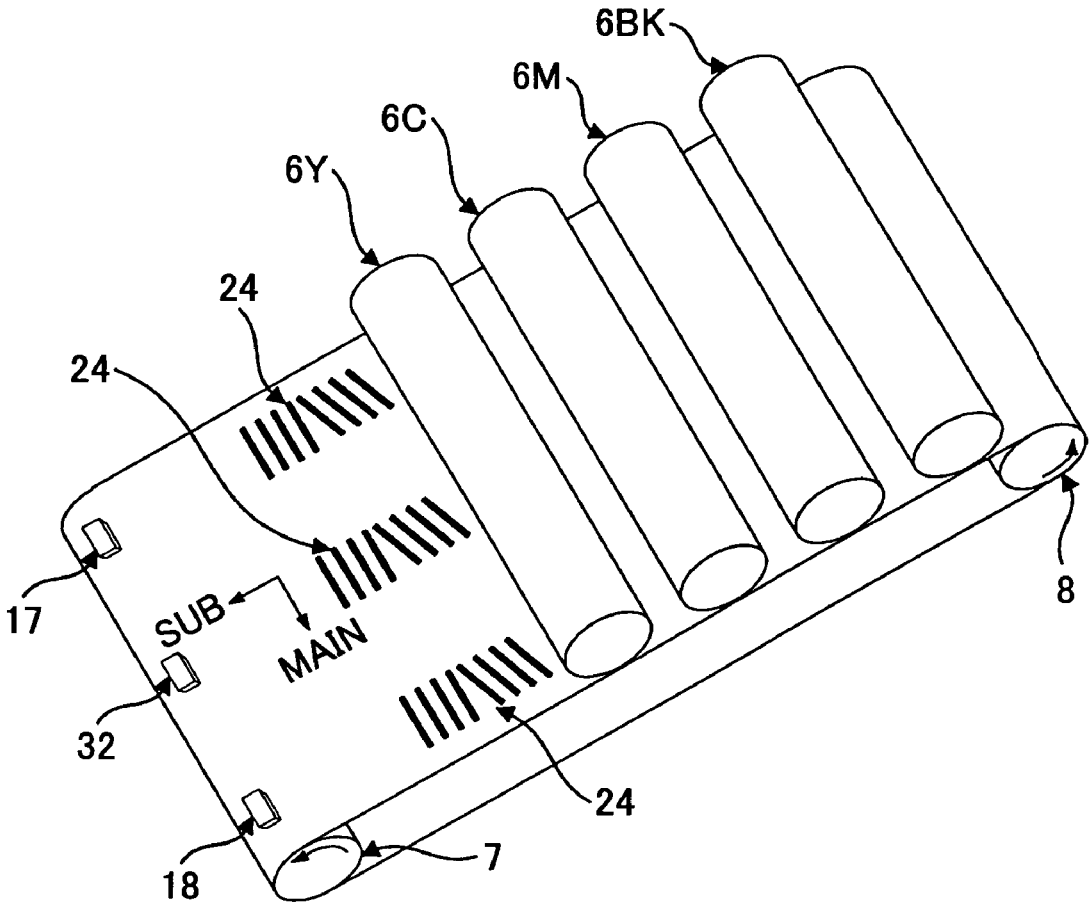
FIG. 8 is a drawing showing image detection sensors together with surrounding components.

FIG. 8 is a drawing showing image detection sensors 17, 18, and 32 together with surrounding components. Image detection sensors 17, 18, and 32 opposing the transfer belt 5 are provided at three respective positions on the downstream side relative to the image forming unit 6Y. The image detection sensors 17, 18 and 32 are secured on a single board, such that the image detection sensors 17, 18 and 32 are arranged in a main scan direction that is perpendicular to the travel direction of the transfer belt 5. The image detection sensors 17 and 18 are disposed at opposite ends in the main scan direction, respectively. The image detection sensor 32 is disposed at a center in the main scan direction. Each of the image detection sensors detects the misalignment correction pattern 24 formed on the transfer belt 5.

The provision of the image detection sensors at three respective positions in this modified embodiment makes it possible to improve the accuracy of color alignment, compared with the case in which the image detection sensors are provided only at two respective positions.

Further, the present invention is not limited to these embodiments, but various variations and modifications may be made without departing from the scope of the present invention.

The present application is based on Japanese priority application No. 2007-143992 filed on May 30, 2007, with the Japanese Patent Office, the entire contents of which are hereby incorporated by reference.

What is claimed is:

1. An image forming apparatus which generates a color image on a transfer belt by superimposing toner images of respective colors generated by image forming units, and transfers the color image onto a transfer medium, comprising:

a correction pattern forming unit configured to form a correction pattern for correcting color misalignment on the transfer belt;

a detection sensor including a regular-reflection receiving device configured to detect the correction pattern formed on the transfer belt by the correction pattern forming unit; and a correction control unit configured to control a width of a subsequent the correction pattern in response to an output of the detection sensor produced by detecting the correction pattern, the width of the subsequent correction pattern being controlled by checking whether a regular-reflection light peak and a diffuse-reflection light peak both appearing in an output of the regular-reflection receiving device satisfy respective threshold conditions.

2. The image forming apparatus as claimed in claim 1, wherein the correction control unit is configured to cause the correction pattern forming unit to generate a correction pattern having such a width that a value of the regular-reflection light peak detected by the regular-reflection receiving device satisfies a first threshold, and that a value of the diffuse-reflection light peak detected by the regular-reflection receiving device satisfies a second threshold.

3. The image forming apparatus as claimed in claim 2, wherein the correction pattern forming unit is configured to form a plurality of correction patterns having varying widths on the transfer belt, and the correction control unit is configured to utilize, for the correction of color misalignment, one of the correction patterns having such a width that the value of the regular-reflection light peak detected by the regular-reflection receiving device satisfies the first threshold, and that the value of the diffuse-reflection light peak detected by the regular-reflection receiving device satisfies the second threshold.

4. The image forming apparatus as claimed in claim 3, wherein the correction control unit is configured to initiate the control of a width of the correction pattern at constant intervals.

5. The image forming apparatus as claimed in claim 3, wherein the correction control unit is configured to initiate the control of width of the correction pattern in response to a change in temperature.

6. The image forming apparatus as claimed in claim 2, wherein the correction control unit is configured to treat the regular-reflection light peak detected by the regular-reflection receiving device as a signal component and to treat the diffuse-reflection light peak detected by the regular-reflection receiving device as a noise component.

7. The image forming apparatus as claimed in claim 6, wherein the correction pattern forming unit is configured to form a plurality of correction patterns having varying widths on the transfer belt, and the correction control unit is configured to select one of the correction patterns having such a width that the noise component included in the output of the regular-reflection receiving device produced by detecting the one of the correction patterns is smaller than a predetermined threshold.

8. The image forming apparatus as claimed in claim 6, wherein the correction pattern forming unit is configured to form a plurality of correction patterns having varying widths on the transfer belt, and the correction control unit is configured to select one of the correction patterns having such a width that the signal component included in the output of the regular-reflection receiving device produced by detecting the one of the correction patterns is larger than a predetermined threshold.

9. The image forming apparatus as claimed in claim 6, wherein the correction pattern forming unit is configured to form a plurality of correction patterns having varying widths on the transfer belt, and the correction control unit is configured to select one of the correction patterns having such a width that the signal component included in the output of the regular-reflection receiving device produced by detecting the one of the correction patterns is larger than a predetermined threshold, and also having such a width that the noise component included in the output of the regular-reflection receiving device produced by detecting the one of the correction patterns is smaller than a predetermined threshold.

10. An image forming apparatus as claimed in claim 1, further comprising two detection sensors configured to detect respective correction patterns.

11. An image forming apparatus which generates a color image on a transfer belt by superimposing toner images of respective colors generated by image forming units, and transfers the color image onto a transfer medium, comprising:

a correction pattern forming unit configured to form a correction pattern for correcting color misalignment on the transfer belt outside an area in which said color image is formed;

a detection sensor including a regular-reflection receiving device configured to detect the correction pattern formed on the transfer belt by the correction pattern forming unit; and a correction control unit configured to control at least one of a length of a subsequent correction pattern in a main-scan direction and a length of the subsequent correction pattern in a sub-scan direction by controlling the correction pattern forming unit in response to an output of the detection sensor produced by detecting the correction pattern, the at least one of the length of the subsequent correction pattern in the main-scan direction and the length of the subsequent correction pattern in the sub-scan direction being controlled by checking whether a regular-reflection light peak and a diffuse-reflection light peak both appearing in an output of the regular-reflection receiving device satisfy respective threshold conditions.

* * * * *